US009926943B2

(12) United States Patent
Rasmussen et al.

(10) Patent No.: US 9,926,943 B2
(45) Date of Patent: Mar. 27, 2018

(54) AXIAL BLOWER

(75) Inventors: Martin Rasmussen, Næstved (DK); Andreas Berglund, Copenhagen (DK)

(73) Assignee: NOVENCO A/S, Naestved (DK)

( * ) Notice: Subject to any disclaimer, the term of this patent is extended or adjusted under 35 U.S.C. 154(b) by 750 days.

(21) Appl. No.: 14/234,654

(22) PCT Filed: Jul. 31, 2012

(86) PCT No.: PCT/EP2012/064908

§ 371 (c)(1),
(2), (4) Date: Apr. 28, 2014

(87) PCT Pub. No.: WO2013/017577

PCT Pub. Date: Feb. 7, 2013

(65) Prior Publication Data

US 2014/0234099 A1 Aug. 21, 2014

(30) Foreign Application Priority Data

Aug. 4, 2011 (DK) ..... 2011 70428

(51) Int. Cl.
*F04D 29/54* (2006.01)
*F04D 29/60* (2006.01)
*F04D 29/64* (2006.01)

(52) U.S. Cl.
CPC ..... *F04D 29/541* (2013.01); *F04D 29/542* (2013.01); *F04D 29/601* (2013.01); *F04D 29/646* (2013.01)

(58) Field of Classification Search
CPC .... F04D 29/541; F04D 29/542; F04D 29/601; F04D 29/646; F01D 9/042; F01D 9/044
See application file for complete search history.

(56) References Cited

U.S. PATENT DOCUMENTS

2003/0185673 A1 10/2003 Matsumoto et al.
2009/0208332 A1* 8/2009 Weinstein ..... F01D 9/042 415/209.3
2011/0052397 A1 3/2011 Kusters et al.

FOREIGN PATENT DOCUMENTS

GB 631 231 A 10/1949
WO WO 2011/044909 A1 4/2011
WO WO 2011/044910 A1 4/2011

OTHER PUBLICATIONS

Jun. 13, 2013 Search Report issued in International Patent Application No. PCT/EP2012/064908.
Jun. 13, 2013 Written Opinion issued in International Patent Application No. PCT/EP2012/064908.

* cited by examiner

*Primary Examiner* — Audrey K Bradley
(74) *Attorney, Agent, or Firm* — Oliff PLC

(57) ABSTRACT

Disclosed is an axial blower that comprises a substantially circular cylindrical blower pipe wherein, in the blower pipe, a blower stator is provided that includes a central construction arranged in the blower pipe and a number of guide blades being disposed downstream of the blower rotor to the effect that they are, at their proximal ends, secured to the central construction and, at their distal ends, securely mounted to the inner side of the blower pipe, whereby the guide blades and the central construction are secured relative to the blower pipe. The central construction includes a number of separate stator segments that are mutually secured to each other; and wherein each of the guide blades is configured as an integral unit along with one of the stator segments.

15 Claims, 4 Drawing Sheets

AXIAL BLOWER

FIELD OF APPLICATION OF THE INVENTION

Figure 1:
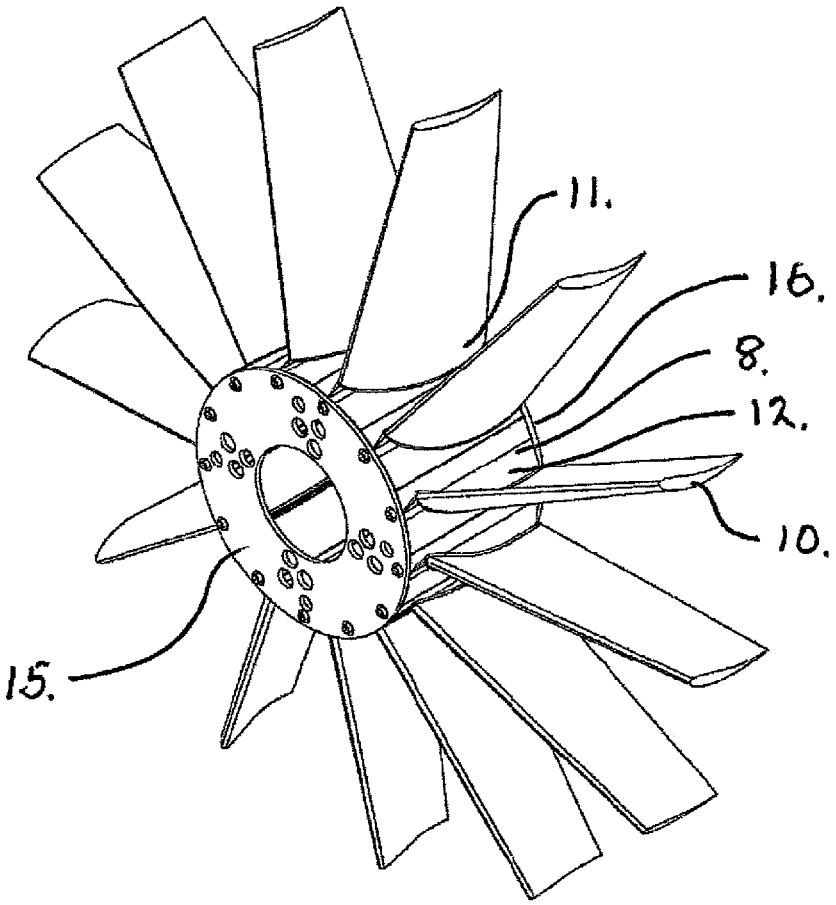

The present invention relates to an axial blower.

Most often, axial blowers comprise a substantially circular cylindrical blower pipe having an inner side and wherein, within the blower pipe, a blower rotor is configured, said blower rotor having a rotor shaft that substantially coincides with the centre axis of the circular cylindrical blower pipe, and a blower stator comprising a central construction arranged in the blower pipe and a number of guide blades being disposed downstream of the blower rotor to the effect that they are, at their proximal end, secured to the central construction and, at their distal end, securely mounted to the inner side of the blower pipe, whereby the guide blades and the central construction are secured relative to the blower pipe.

STATE OF THE ART

Today, several different embodiments of axial blowers of the above-mentioned types are known that most often serve the function, in addition to functioning as a central mounting site for the guide blades, of acting as mounting site for the drive motor intended for driving the blower rotor. Thus, the central construction often comprises a stator pipe having a diameter which corresponds substantially to the diameter of the hub of the blower rotor, and wherein the blower rotor is disposed upstream of the central construction, and the drive motor is disposed within the central construction or behind same to the effect that the drive shaft by which the drive motor drives the blower rotor around extends through the central construction. Thus the central construction absorbs large forces, and it is consequently important that the central construction is of a very robust build.

It is thus a constant challenge in the development of such axial blowers to achieve that, all other things being equal, and with a given motor effect to drive the blower rotor, the highest possible pressure increase and/or the highest possible throughput of air is/are accomplished, while simultaneously the production costs associated with the manufacture of the axial blower is kept as low as possible.

OBJECT OF THE INVENTION

Based on this it is the object of the present invention to provide an axial blower of the kind described above whereby, by simple means, a high efficiency of the axial blower can be accomplished, while simultaneously the production costs associated with the manufacture of the axial blower are minimised.

This is accomplished in that the central construction comprises a number of separate stator segments that are mutually secured to each other; and in that each of the guide blades is configured as an integral unit along with one of the stator segments.

Thereby it is possible to manufacture each of the integral units in a moulding process to the effect that both each guide blade is integrally moulded in metal along with one of the stator segments.

In a preferred embodiment, the central construction is configured as a stator pipe having a centre axis that coincides with the centre axis of the blower pipe.

In this context, the number of guide blades particularly advantageously corresponds to the number of stator segments; and in that the stator segments combine to form the stator tube.

According to a preferred embodiment by which particularly low manufacturing costs are accomplished, the integral units are alike.

In this context, each of the stator segments particularly advantageously has an outer surface at the proximal end of the guide blade, from where the guide blade extends, said outer surface being single-curved with a radius of curvature corresponding to the radius of the stator pipe.

Thereby the outer surface of the stator pipe can be formed of the outer surfaces of the stator segments if each of the outer surfaces of the stator segments each has a first side edge and an opposed second side edge which is just as long as and complementarily configured relative to the first side edge to the effect that two adjacent stator segments in the stator tube abut on each other in such a way that the first side edge on the one stator segment abuts on the second side edge on the second stator segment.

According to a preferred embodiment, stator segments have two opposed end faces that are essentially plane and parallel and are oriented such that they are situated in the same plane as the corresponding ones opposed on another stator segment when the side edges thereon abut on each other.

Thereby it is enabled that the stator elements are retained relative to each other by means of an essentially circular cover plate having an outer radius corresponding to the outer radius of the stator tube, and wherein one of the end faces of each of the stator elements abuts on and is secured to a side on the circular cover plate.

The stator elements can further be retained relative to each other by means of another circular cover plate having an outer radius corresponding to the outer radius of the stator tube, and wherein the second one of the end faces of each of the stator elements abuts on and is secured to a side on the circular cover plate.

In the context of this, it is possible to mount the stator segments to the cover plates in a number of different ways, such as by use of bolts, by welding or sintering, etc. According to a preferred embodiment, the stator elements according to the invention are secured to the circular cover plate by means of one or more pins that extend from the end faces of the stator elements and through holes in the cover plate intended therefor; and by the pins being forged or in other ways deformed plastically to the effect that they have a larger cross section on that part of the pin which extends from the opposite side of the cover plate relative to the stator elements.

LIST OF FIGURES

Figure 3:
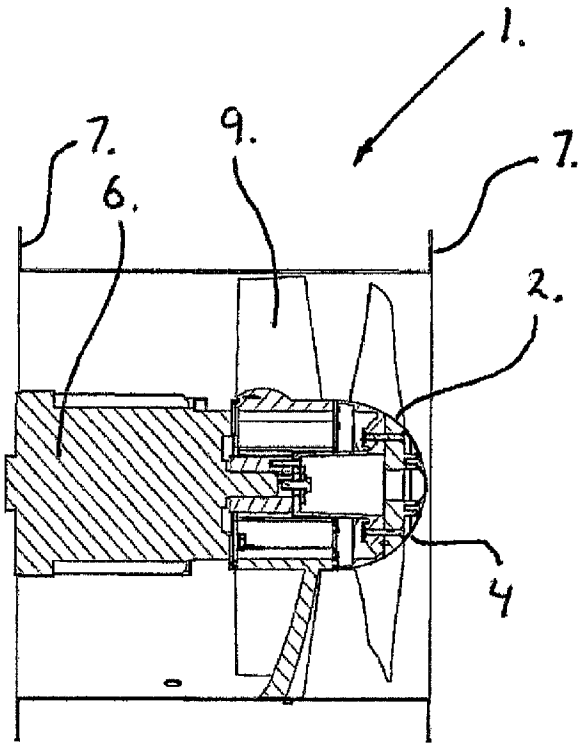
Figure 2:
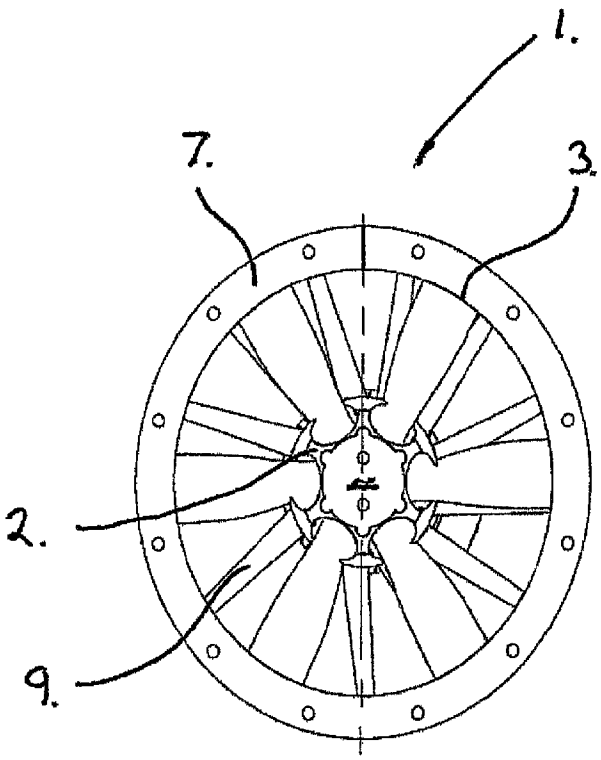
Figure 5:
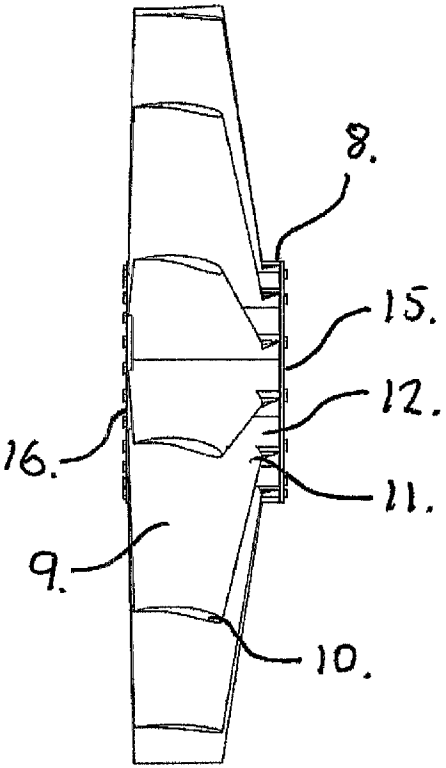
Figure 4:
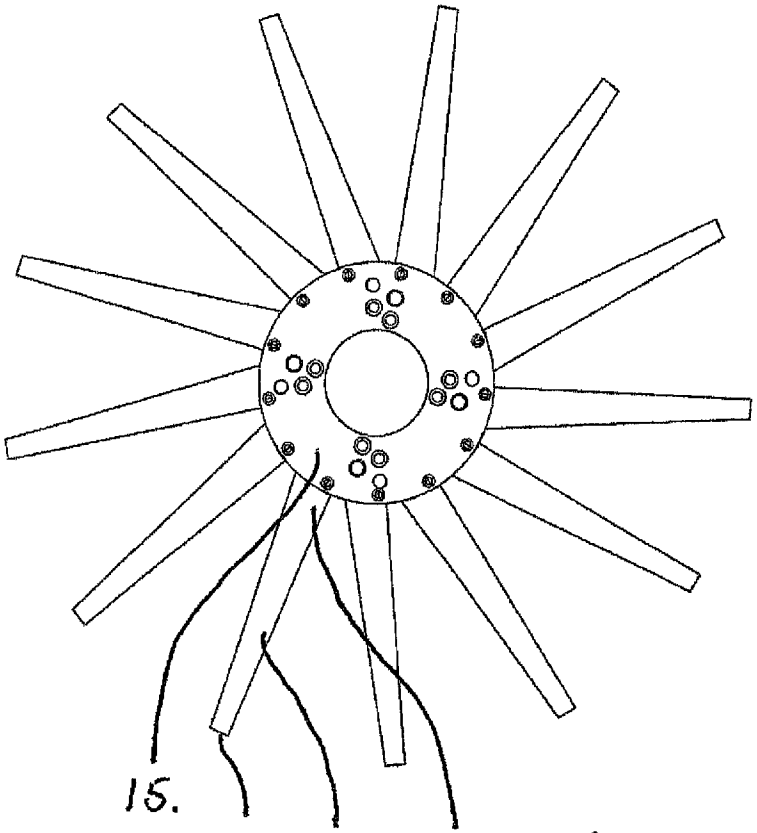
Figure 7:
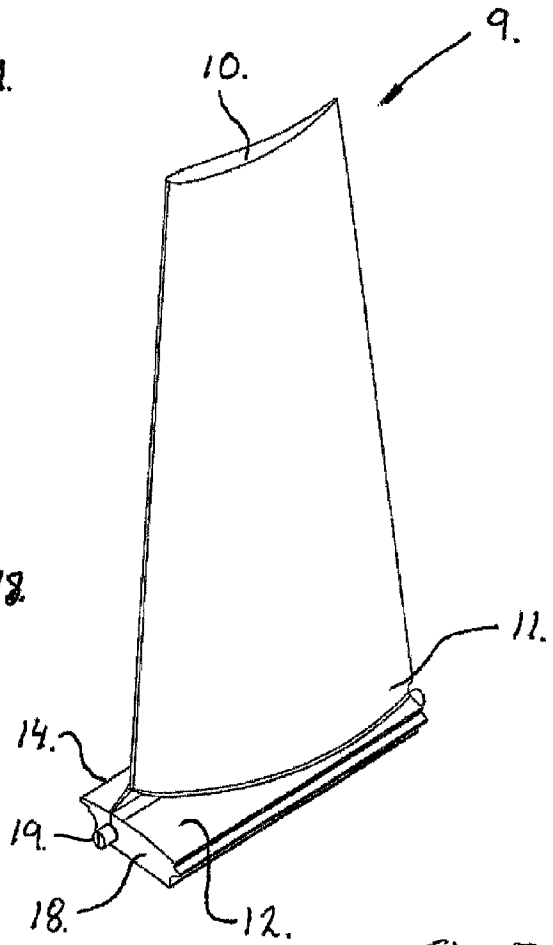
Figure 6:
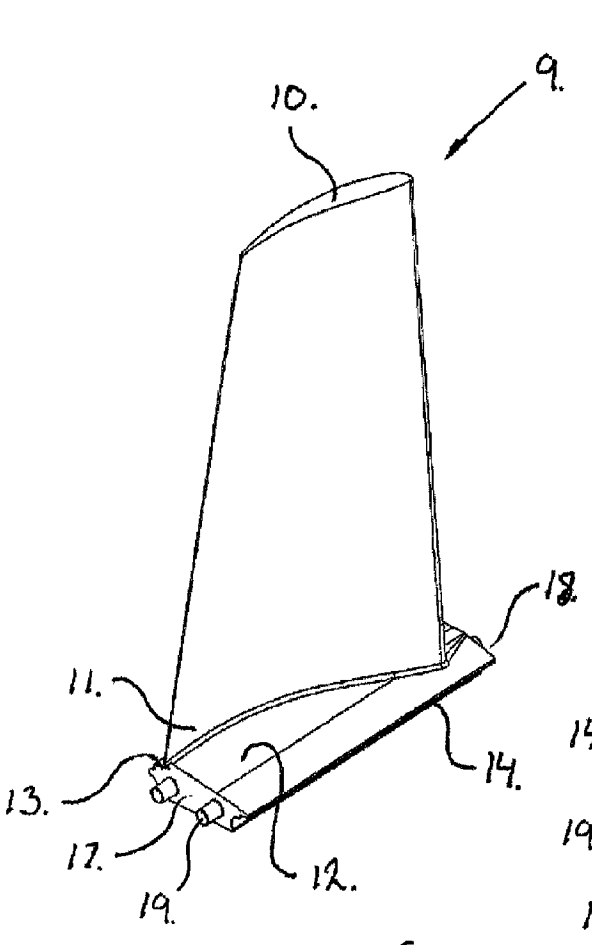

FIG. 1; is a perspective view of a guide apparatus for an axial blower according to the invention, seen in an inclined view from in front and from above;

FIG. 2: is a view of an axial blower according to the invention, seen from in front;

FIG. 3: is a sectional view showing the axial blower shown in FIG. 2, seen in a vertical sectional view from the side;

FIG. 4: is a view of the guide apparatus shown in FIG. 1, seen straight from in front;

FIG. 5: is a view of the guide apparatus shown in FIGS. 1 and 4, seen from the side;

FIG. 6: is a perspective view of a stator segment with an integral guide blade, seen in an inclined view from behind and from the top;

FIG. 7: is a perspective view of the stator segment shown in FIG. 6, seen in an inclined view from in front and from above.

EMBODIMENT OF THE INVENTION

Thus, FIGS. 2 and 3 show an axial blower 1 according to the present invention, said axial blower 1 having a blower rotor 2, in the shape of a propeller which is driven around by a motor 6; said blower rotor 2 having a rotor hub 4 which is mounted on a rotor shaft which is driven around by the motor 6 about the centre axis of the rotor 2.

The rotor 2 is arranged centrally in a blower pipe 3 which is, at both its ends, provided with a mounting flange 7 extending outwards from the blower pipe 3 and which is provided with bolt holes for mounting of the axial blower 1 in a piping system, such as a ventilation system, where it serves the purpose of forcing air through the piping system. However, the axial blower may also be used as a free blower, and in that context it will conveniently be configured with a suction funnel intended therefor and optionally free blowing-off.

Behind the rotor 2 and hence downstream thereof, a guide apparatus is provided, said guide apparatus being shown in detail in FIGS. 1, 4, and 5. That guide apparatus comprises a stator tube 8 and a number of guide blades 9 that extend from the stator tube 8 and all the way to the blower pipe, wherein the guide blades 9 are, in a known manner, securely attached at their distal ends 10 to the inner side of the blower pipe 3 as will appear from FIG. 3. The drawing does not show how that attachment is made, but it will be known to the person skilled in the art that this can conveniently be done by means of a number of bolts that extend from the outer side on the blower pipe 3 and inwards onto its inner side, where they are screwed into the distal end 10 on each of the guide blades 9.

Thereby the guide blades 9 and the central stator tube 8 are secured relative to the blower pipe 3 to the effect that the guide blades serve, in a known manner, the purpose of rectifying the flow of air generated by the blower rotor and reducing turbulence therein.

The centrally arranged stator tube thus retains the proximal end 11 on each of the guide blades 9 in relation to each other, but apart from that the stator tube may also constitute a convenient mounting site for mounting of the blower motor 6, and the blower rotor 2 mounted thereon. The stator tube 8 and the guide blades 9 therefore absorb, in this embodiment, the forces that are generated by the blower motor 6, when it causes the blower rotor 2 to rotate, and in the context of this it is important that the stator tube 8 and the guide blades constitute a robust construction.

According to the invention, the stator tube 8 is thus configured from a number of separate stator segments 12, each of which is configured as an integral unit along with a guide blade 9 as will appear from FIGS. 6 and 7. That integrated unit may eg be manufactured in a moulding process, as it is hereby possible to create, in one and the same process, the complex profile that each guide blade 9 must have, while simultaneously it is possible to accomplish a very rigid and robust construction of each integral unit.

In the shown embodiment, the individual stator segments 12 are assembled to form the stator tube 8, a number of the stator segments 12 being assembled in abutment on each other at their opposed side edges 13, 14 that delimit their outer surface from where the guide blades 9 extend. To secure the stator segments 12 in a fixed position relative to each other there are, in this embodiment, arranged two circular cover plates 15, 16 that abut on opposed end faces 17, 18 on each of the stator segments 12, and on each of the stator segments 12 there is/are configured one or more protruding pins 19 that is/are thereby caused to extend through a corresponding number of holes in the cover plates 15, 16, following which they are deformed plastically by forging or another process to the effect that the cover plates 15, 16 hold the individual stator segments in a mutual position with the side edges 13, 14 in abutment on each other.

Thereby the cover plates 15 and 16 constitute a convenient mounting site for the blower motor.

It will be clear to the person skilled in the art that it will be possible, without departing from the principle of the invention, to combine the stator tube 8 from different numbers of integral units; and that it is thereby possible to build guide apparatuses that are optimised for various blower constructions and specifications by use of few constituent components. Based on this, it will also be obvious to the person skilled in the art that a stator tube 8 can comprise one or more stator segments 12, on which a guide blade 9 is not mounted, but that there will at least be a need for three or more of the stator segments 12 to constitute an integral unit along with a guide blade 9.

The invention claimed is:

1. An axial blower, comprising:
- a motor;
- a circular cylindrical blower pipe having an inner side; and
- a blower rotor located within the blower pipe, the blower rotor having a rotor shaft that coincides with a centre axis of the circular cylindrical blower pipe, and
- a blower stator comprising:
  - a central construction arranged in the blower pipe, the rotor shaft extending through the central construction and being operatively connected to the motor, the motor being directly mounted on the central construction of the blower stator; and
  - a number of guide blades being disposed downstream of the blower rotor and having a proximal end and a distal end,
  - the proximal ends of the guide blades being secured to the central construction, and
  - the distal ends of the guide blades being securely mounted to the inner side of the blower pipe,
- whereby the guide blades and the central construction are secured relative to the blower pipe, wherein
- the central construction comprises a number of separate stator segments that are mutually secured to each other, and
- each of the guide blades is configured as an integral unit along with one of the stator segments.

2. An axial blower according to claim 1, wherein the central construction is configured as a stator pipe having a centre axis that coincides with the centre axis of the blower pipe.

3. An axial blower according to claim 2, wherein the integral units are made with a same moulding process.

4. An axial blower according to claim 2, wherein the number of guide blades corresponds to the number of stator segments, and the stator segments combine to form the stator pipe.

5. An axial blower according to claim 4, wherein the integral units are made with a same moulding process.

6. An axial blower according to claim 1, wherein each of the integral units comprises an integrally moulded workpiece of metal.

7. An axial blower according to claim 6, wherein the central construction is configured as a stator pipe having a centre axis that coincides with the centre axis of the blower pipe.

8. An axial blower according to claim 6, wherein the integral units are made by a same moulding process.

9. An axial blower according to claim 8, wherein the central construction is configured as a stator pipe having a centre axis that coincides with the centre axis of the blower pipe, wherein each of the stator segments has an outer surface at the proximal end of one of the guide blades, and from where the one of the guide blades extends, said outer surface being curved with a radius of curvature corresponding to a radius of the stator pipe.

10. An axial blower according to claim 9, wherein an outer surface of the stator pipe is formed of the outer surfaces of the stator segments, each outer surface of the stator segments having a first side edge and an opposed second side edge which is as long as and complementarily configured relative to the first side edge so that two adjacent stator segments of the stator pipe abut on each other in such a way that a first side edge on a first stator segment of the two adjacent stator segments abuts on a second side edge on a second stator segment of the two adjacent stator segments.

11. An axial blower according to claim 10, wherein the first stator segment and the second stator segment each have two opposed end faces that are planar and parallel and are oriented such that one of the end faces of the first stator segment and one of the end faces of the second stator segment are situated in the same plane when the first side edge of the first stator segment abuts the second side edge of the second stator segment.

12. An axial blower according to claim 11, wherein the stator segments are retained relative to each other by means of a first circular cover plate having an outer radius corresponding to an outer radius of the stator pipe, and wherein a first one of the end faces of each of the stator segments abuts on and is secured to a side on the first circular cover plate.

13. An axial blower according to claim 12, further comprising a second circular cover plate, wherein the first one of the end faces of each stator segment comprises a pin that extends through a hole in the first circular cover plate to retain the stator segments to the first circular cover plate, wherein a second one of the end faces of each stator segment comprises a pin that extends through a hole in the second circular cover plate to retain the stator segments to the second circular cover plate, and wherein the pins extending through the holes in the first and second circular cover plates are plastically deformed and have a portion with a larger cross-section than another portion thereof.

14. An axial blower according to claim 12, wherein the stator segments are further retained relative to each other by means of a second circular cover plate having an outer radius corresponding to the outer radius of the stator pipe, and wherein a second one of the end faces of each of the stator segments s abuts on and is secured to a side on the second circular cover plate.

15. An axial blower according to claim 14, wherein the first one of the end faces of each stator segment comprises a pin that extends through a hole in the first circular cover plate to retain the stator segments to the first circular cover plate, wherein the second one of the end faces of each stator segment comprises a pin that extends through a hole in the second circular cover plate to retain the stator segments to the second circular cover plate, and wherein the pins extending through the holes in the first and second circular cover plates are plastically deformed and have a portion with a larger cross-section than another portion thereof.

* * * * *